US005611699A

United States Patent [19]

Tanigawa

[11] Patent Number: 5,611,699

[45] Date of Patent: Mar. 18, 1997

[54] TAPE-CARRIER-TYPE ELECTRICAL CONNECTOR AND METHOD OF MANUFACTURING SAME

[75] Inventor: Junichi Tanigawa, Kawasaki, Japan

[73] Assignee: The Whitaker Corporation, Wilmington, Del.

[21] Appl. No.: 354,703

[22] Filed: Dec. 13, 1994

[30] Foreign Application Priority Data

Dec. 29, 1993 [JP] Japan ..... 5-075067 U
May 19, 1994 [JP] Japan ..... 6-129782

[51] Int. Cl.[6] ..... H01B 9/09

[52] U.S. Cl. ..... 439/78; 439/885

[58] Field of Search ..... 439/75, 78, 83, 439/885, 937

[56] References Cited

U.S. PATENT DOCUMENTS

| | | | |
|---|---|---|---|
| 3,951,494 | 4/1976 | Romine | 439/81 |
| 4,634,200 | 1/1987 | Dechelette | 439/75 |
| 4,767,342 | 8/1988 | Sato | 439/83 |
| 4,807,087 | 2/1989 | Sawaya | 439/83 |
| 4,897,047 | 1/1990 | Connell et al. | 439/189 |
| 4,934,943 | 6/1990 | Klein et al. | 439/65 |
| 4,996,766 | 3/1991 | Piorunneck et al. | 439/885 |
| 5,141,450 | 8/1992 | Kikuchi et al. | 439/560 |

FOREIGN PATENT DOCUMENTS

| | | |
|---|---|---|
| 62-116377 | 7/1987 | Japan . |
| 63-107965 | 7/1988 | Japan . |
| 1-62668 | 4/1989 | Japan . |

*Primary Examiner*—P. Austin Bradley
*Assistant Examiner*—Jill Demello

[57] ABSTRACT

Contact tie-ins (68, 70, 72) are arrayed in two rows at the bottom (20) of the housing (10) of tape-carrier type electric connector (1). Tie-ins (68) and (70) are located nearly at the center line of the bottom (20), and tie-ins (72) are arranged in a row located at some distance from the center line. Tie-ins (68) which also play the role of the posts are longer than tie-ins (70) and (72), and they are attached to the carrier tape.

12 Claims, 9 Drawing Sheets

TAPE-CARRIER-TYPE ELECTRICAL CONNECTOR AND METHOD OF MANUFACTURING SAME

FIELD OF THE INVENTION

This invention relates to electrical connectors, especially to the tape-carrier type connectors which are secured to a carrier tape during the manufacturing process, and to methods of their manufacture.

BACKGROUND OF THE INVENTION

Electrical connectors attached to a carrier tape for the purpose of facilitating the assembly process of the final products are extensively used in the field of production of home appliances. An example of such electrical connectors can be found in Japanese Utility Model No. Publication No. 91-53762. The electrical connectors of this type have an auxiliary wire by means of which the connectors are attached to a carrier tape running between two rows of connecting conductors extending from the housing bottom. This auxiliary wire is located near the center line of the housing bottom so that the chuck feeding the electrical connectors to the circuit boards of the final products can handle them without tilting.

However, some electrical connectors (such as bottom-entry connectors) are intended for connecting together two circuit boards. One example of such connector is described in Japanese Utility Model Publication No. 87-116377. One connector in this connector set (referred to below as the first connector) is mounted to the circuit board located at the top and has a female-type connecting section extending downward (to a circuit board). Another connector (referred to below as the second connector) is mounted to a circuit board located below the first one, and has male contacts which form connection with the female-type connecting section of the first connector via an opening made in the top circuit board.

In order to supply the first connectors attached to a carrier tape, the auxiliary wire posts have to be located at the center line of the housing bottom. However, it is necessary to make through holes in the circuit board for the posts of the first connector which will be located near the opening for the female-type connection section. Making these through holes some distance from the opening and from each other does not create any problem. But when they are close to each other, there is a danger that a crack will appear in the circuit board.

In addition, in the connector described in the above mentioned Japanese Utility Model Publication No. 87-116377, the connector tie-ins are arranged in one row. Therefore, if the contact pitch is decreased, the lands on the surface of the circuit board become too close to each other, and their formation becomes extremely difficult, if not impossible. This means that this design is not suitable for a high density devices.

Therefore, the purpose of this invention is to offer a tape-carrier type electrical connector free of the above mentioned disadvantages suitable for high-density applications.

SUMMARY OF THE INVENTION

The tape-carrier type electrical connector according to this invention comprises a number of contacts having a contacting section intended for making. connection with matching contacts or an electrical wire and a termination section intended for insertion in through holes of a base board, and a housing containing the contacts, with a part of the above mentioned termination sections being arrayed in one row located approximately along the center line of the bottom of the housing and the termination sections of the remaining contacts being arrayed in another row on the bottom of the housing separated from the center line, at least two termination sections of the above mentioned part of the contacts are made longer than the other termination sections for the purposes of securing to a carrier member.

In addition a method of manufacture of the tape-carrier connector according to this invention comprises a process of forming a carrier attachment in the form of a number of contacts of the same shape arranged in one row, a process of removing the carrier from the contacts, a process of insertion of the contacts in the housing and bringing them out through the bottom of the above mentioned housing, a process of a selective cutting of the contacts to three different lengths, a process of bending the contacts so that the contact termination sections of the medium length form a row located at a position different from the other tie-ins, and a process of attachment of a carrier tape to the longest termination sections out of contacts of three different lengths.

A part of termination sections are arranged on the center line of the housing bottom, and at least two of them are attached to a carrier tape. This means that at least two termination section also play the role of posts attaching the connector to the carrier tape. This makes it possible to reduce the number of holes to be made in the circuit board, to facilitate the task of designing the pattern of the circuit boards, to reduce dimensions of the connectors, and to reduce their production cost.

In addition, since the termination sections are separated in two rows, the lands are not too close to each other, and are easy to make. In other words, the contact pitch can be reduced without crowding lands, thereby making miniaturization possible.

BRIEF DESCRIPTION OF THE DRAWINGS

Embodiments of the present invention will now be described by way of example with reference to the accompanying drawings, in which.

DETAILED DESCRIPTION OF THE INVENTION

Figure 1A:
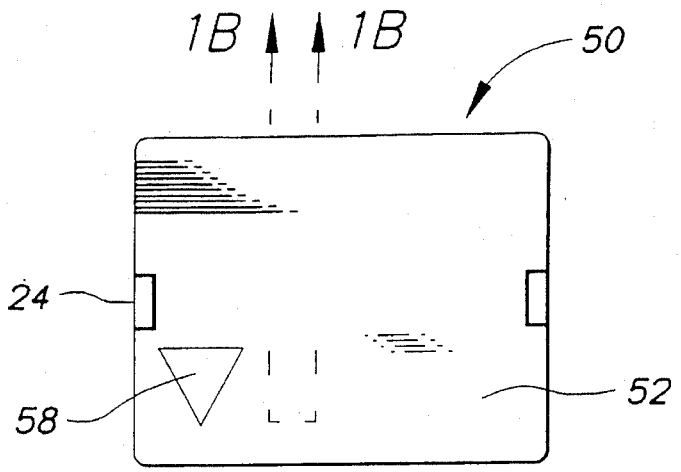
FIG. 1 is an embodiment of the tape-carrier type electric connector according to this invention: (A) plan view; (B) front elevation; (C) bottom view; (D) left elevation.

The connector 1 has an insulating housing 10 of nearly rectangular shape, a cover 50 closing the top of the housing 10 and contacts 60, 62, 64 located in the insulating housing 10. The insulating housing 10 is molded of a polyamide resin or a similar insulating material, and it has opposed side walls 12 and 14, opposed end walls 16, 18 and a bottom 20. The top of the insulating housing 10 is open for the placement of the contacts 60, 62, 64. The contacts 60, 62, 64 are concealed under the cover 50. The cover 50 has a rectangular body 52 covering the top of the housing 10 and two latching arms 54 extending perpendicular to the body 52 at its both ends. Since the latching arms 54 fit into recesses 22 made in the side walls 16, 18 of the housing 10, after assembly, they do not extend over the surface of the side walls 16, 18. In the center of the latching arms 54, there are recesses 56 into which latching lugs 24 of the recesses 22 fit. This prevents the cover 50 from separating from the housing 10. A mark 58 indicates the contact No. 1.

In the insulating housing 10, there are contact chambers 26 and molded, empty cavities 28, 30 connecting to the top opening for the contacts 60, 62, 64. The contact chambers 26 are made for the purpose of placing contacting sections 66 of the contacts 60, 62 and 64. They are connected to the insertion openings 32 made in the bottom 20 for the matching male-type contacts (not shown in the drawing). These insertion openings 32 have tapered surface 34 made to facilitate insertion of the male-type contacts. Instead of a male type contact, a relatively rigid tin-coated wire may be inserted. At the edges of the tapered surfaces 34, beads 36, 36 are made on opposite walls and their front ends nearly come together. Each pair of the beads 36, 36 almost completely close the insertion opening 32, thus protecting the insertion opening from penetration of flux from underneath. The empty cavities 28 are provided for a partial exposure of tie-ins 68, 70 of the contacts 60, 62. This results in that most of the flux which penetrated due to capillary effect between tie-ins 68, 70 of the contacts 60, 62 and the tie-in insertion opening 38 remains in the empty cavity 28, thus preventing the flux from getting on the contacting section 66. Empty cavity 30 has a similar function: it exposes the linking section 76, which results in the fact that the flux rising along tie-in 72 remains at the bottom of the empty cavity 30, thus preventing the contacting section 66 from fouling. A portion of the flux rising along tie-ins 68, 70, 72 which is moving over the bottom 20 of the housing 10 remains in the groove 42 made along the rows of tie-ins 68, 70, thus preventing it from penetration in the insertion opening 32. In addition, in four corners of the bottom 20 of the housing 10, stand-offs 44 are provided which creates a distance between the bottom 20 and the circuit board (not shown in the drawing). As the result of this, only minute amounts of flux can rise along tie-ins 68, 70, 72.

Figure 4:
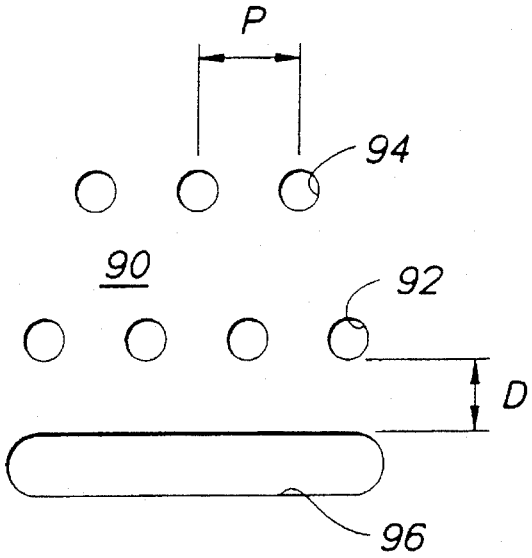
FIG. 4 is a plan view of the pattern of through holes made in the circuit board for the mounting of the connector shown in FIG. 1.

FIG. 4 is the top view showing the pattern of the openings provided for the mounting of the connector shown in FIG. 1 to a circuit board. As shown in FIG. 1 (C), tie-ins 68, 70 are arrayed in one row near the center line of the bottom 20 of the housing 10. In addition, near the side wall 14 at the bottom 20, a row of tie-ins 72 is provided parallel to the row of tie-ins 68, 70. Tie-ins 68, 70 and tie-ins 72 are arranged in a staggered pattern. Near the side wall 12 at the bottom 20, the insertion openings 32 are arranged in one row parallel to the row of tie-ins 68, 70. Therefore, as shown in FIG. 4, it is possible to provide in the circuit board 90 through holes 92 corresponding to tie-ins 68, 70 through holes 94 corresponding to tie-ins 72 and an elongated through hole 96 corresponding to the row of the insertion openings 32. Moreover, an ample spacing can be provided between through holes 92 and the elongated through hole 96. For example, through holes 92 and 94 can be spaced at a pitch of P=2.5 mm in a staggered pattern, and the distance between through holes 92 and the elongated through hole 96 can be D=1.75 mm. Since this distance is greater than the thickness of an average circuit board (1.6 mm), no cracks appear at the through holes 92 or the elongated through hole 96. Since the through holes 92, 94 are staggered, lands (not shown in the drawing) for soldering tie-ins 68, 70, 72 can be easily made on the circuit board. Since the land can be sufficiently spaced, designers of the circuit boards have more freedom in designing wiring pattern and the placement of other elements.

Figure 1B:
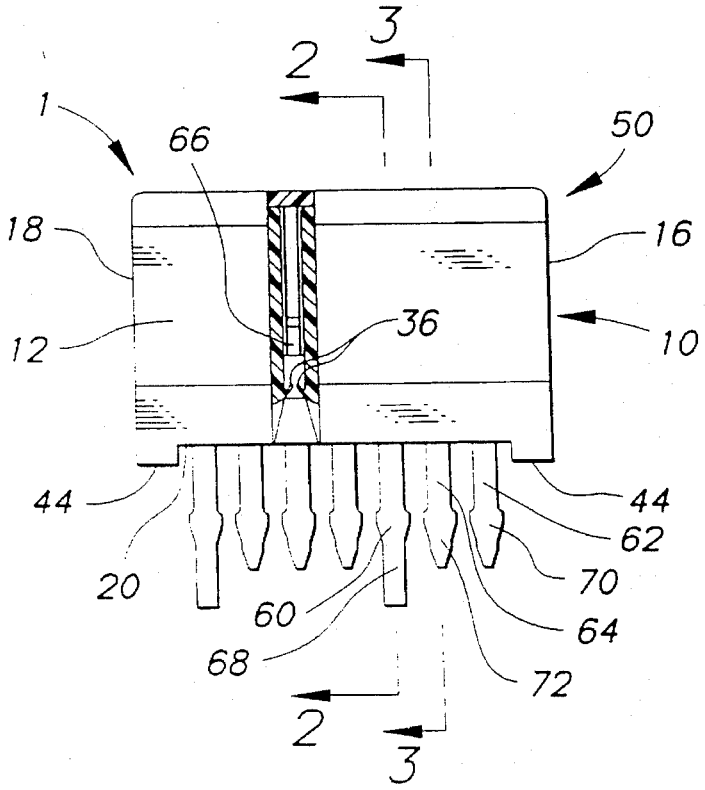
Figure 1C:
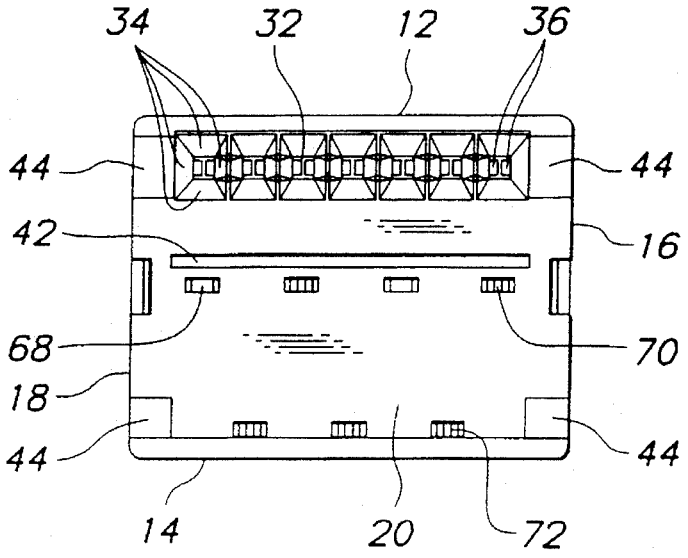
Figure 1D:
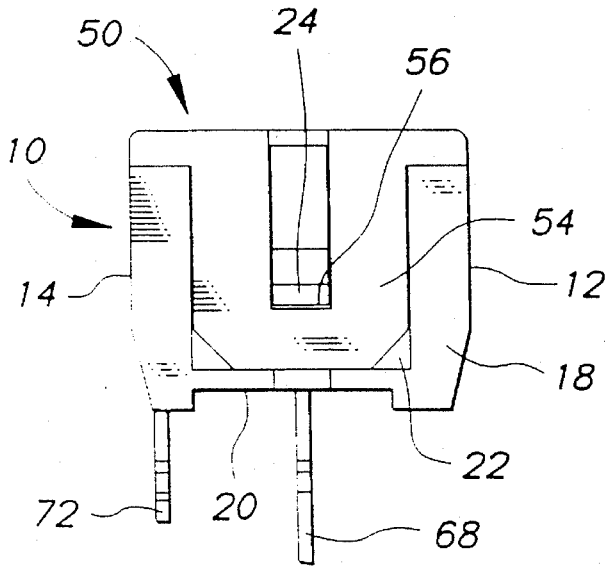
Figure 2:
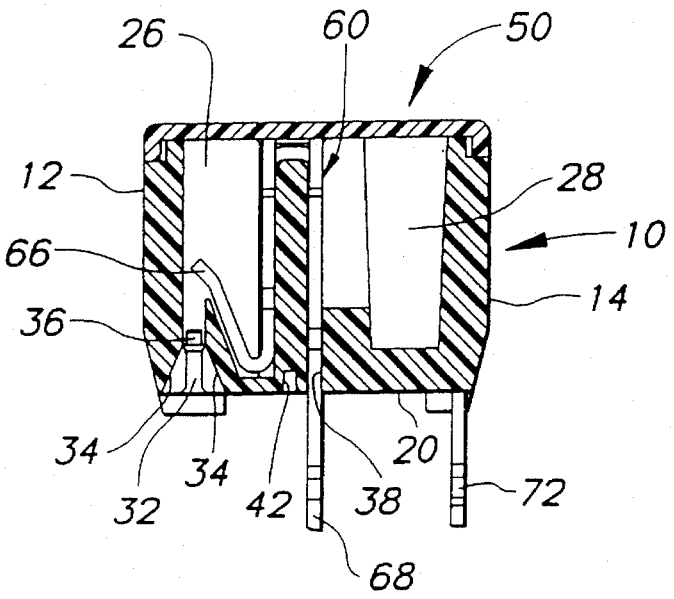
FIG. 2 is a cross sectional view along line II—II in the FIG. 1(B).
Figure 3:
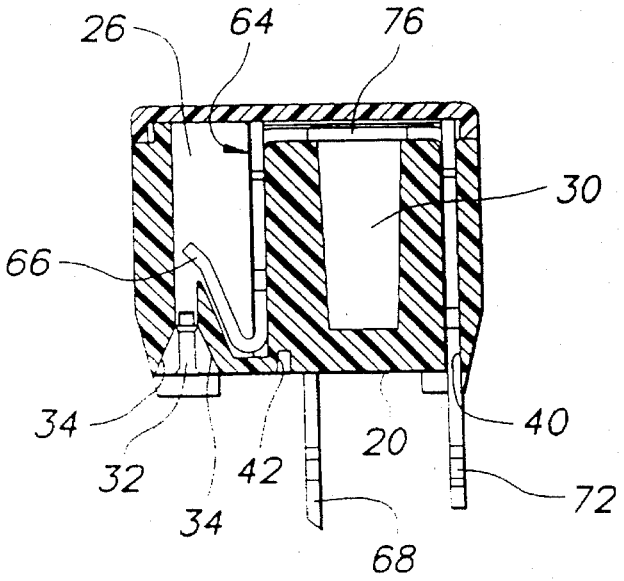
FIG. 3 is a cross sectional along line III—III in FIG. 1(B).

As shown in FIGS. 1(B) and (C), two tie-ins 68 from the row of tie-ins located near the center line of the bottom 20 are longer than tie-ins 70. As it will be explained below, the two tie-ins 68 play the role of posts attaching the connector to a carrier tape 100 (see FIG. 7). This eliminates the need for auxiliary wires or posts to be affixed to the insulating housing 10. As a result, it becomes possible to reduce the number of elements in the connector 1, thus reducing its manufacturing costs.

Figure 5:
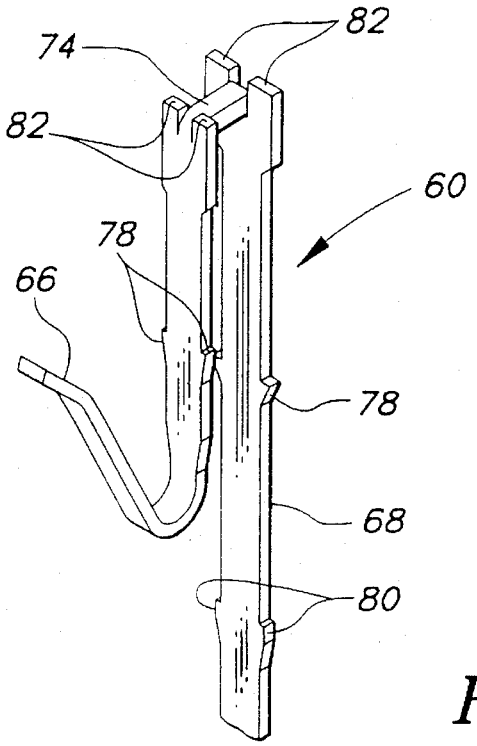
FIG. 5 is an oblique view of a contact used in the connector shown in FIG. 1.
Figure 6:
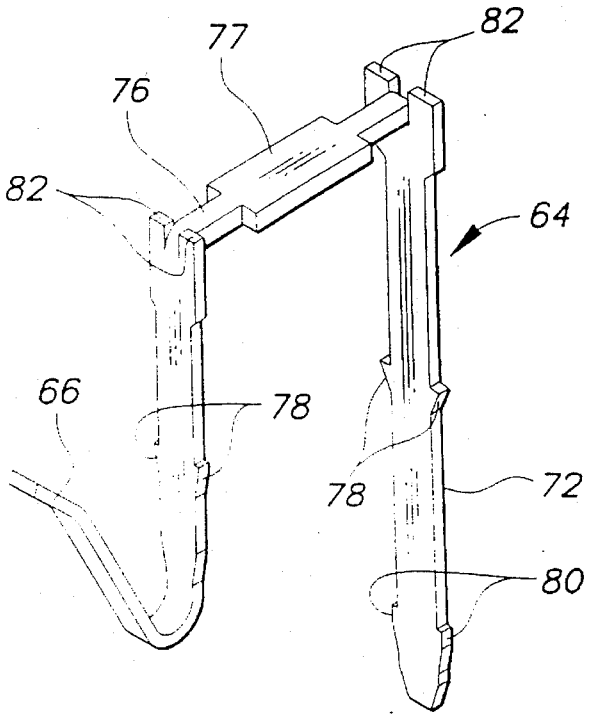
FIG. 6 is an oblique view of a contact used in connector shown in the FIG. 1.
Figure 8A:
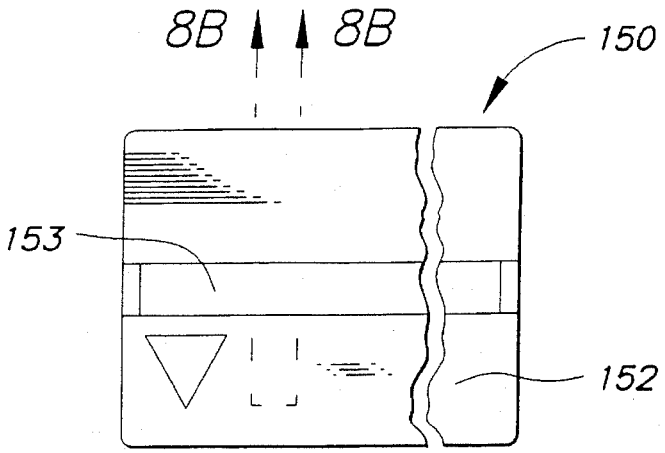
FIG. 8 is another embodiment of the connector: (A) top view; (B) front elevation; (C) bottom view; (D) left elevation.
Figure 8B:
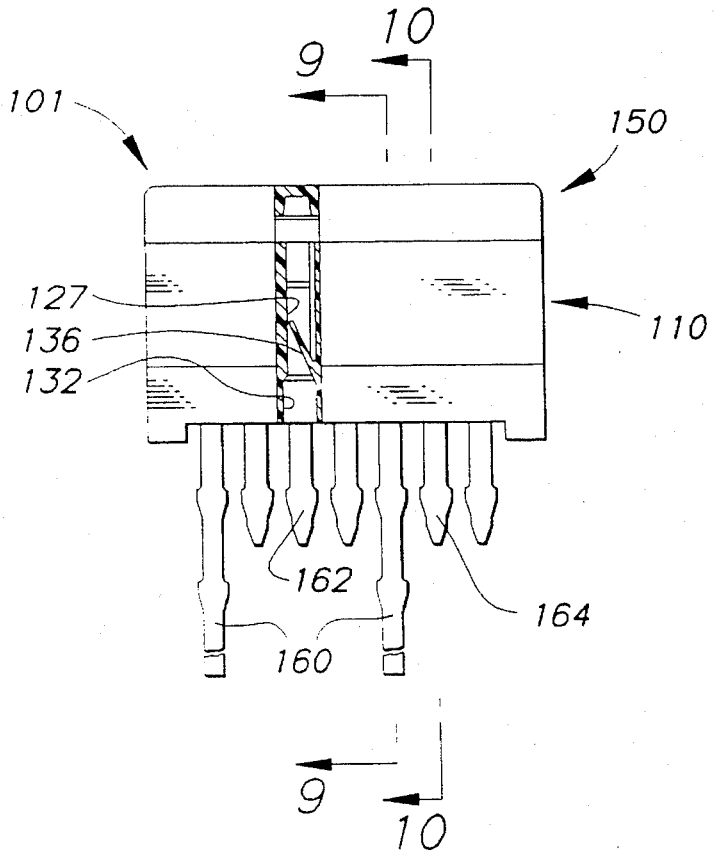
Figure 8C:
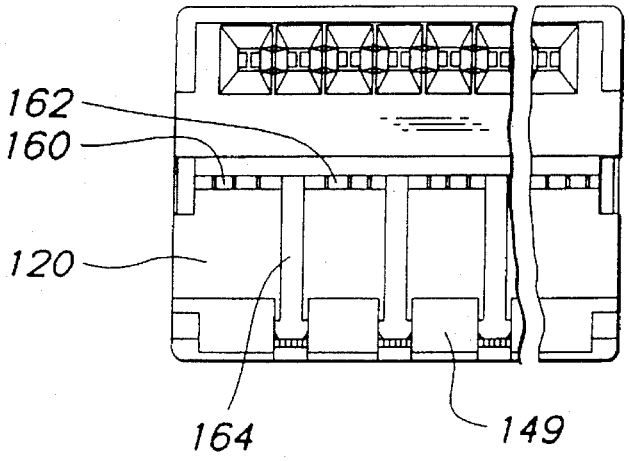
Figure 8D:
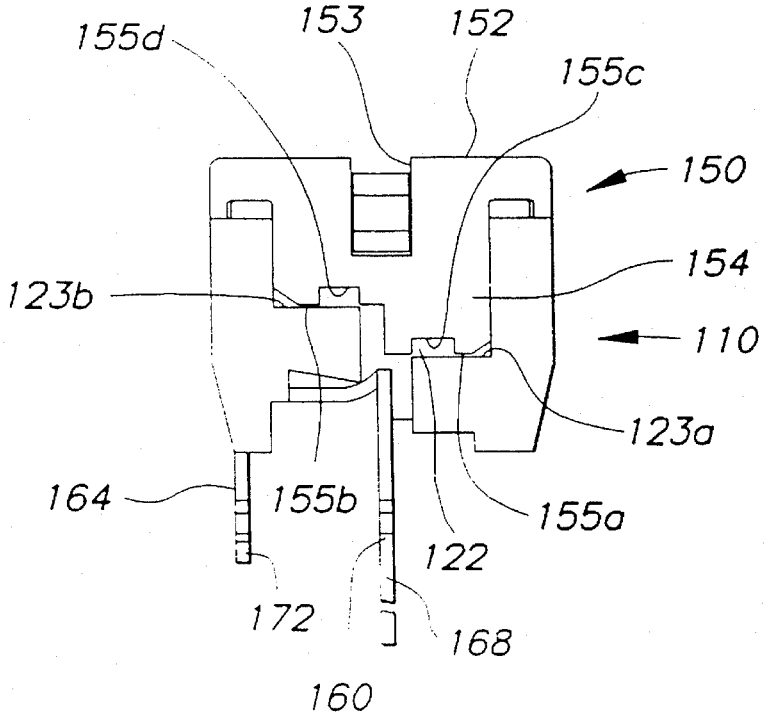
Figure 9:
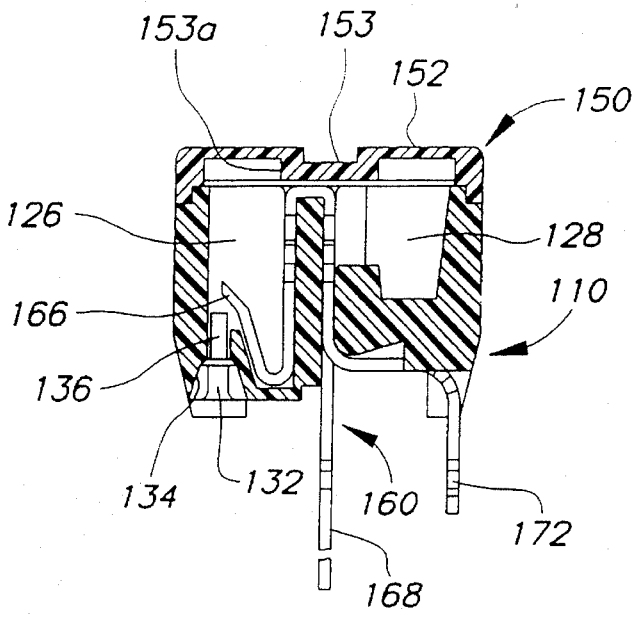
FIG. 9 is a cross sectional view along line IX—IX in FIG. 8(B).

FIG. 5 is a perspective view of the contact 60 having a long tie-in 68. FIG. 6 is a perspective view of the contact 64 having a tie-in 72. Contacts 60, 62, 64 are stamped from a sheet of a copper alloy or other material, treated and bent to the required configuration. The contact 60 shown in FIG. 5 has a V-shaped contacting section 66, a relatively long tie-in section 68 and a linking section 74 connecting the contacting section 66 and the tie-in section 68. The free end of the contacting section 66 comes in contact with a matching male-type contact (not shown in the drawing) when it is inserted through the insertion opening of the insulating housing 10. The contacting section 66 and the tie-in section 68 have paired lugs 78. These lugs 78 are pressed in the walls of the insulating housing 10 securing the contact 60 therein. The tie-in section 68 has an additional pair of lugs 80. The function of these lugs 80 is to prevent misalignment of the tie-in 68 and the through hole 92 in the event of a clinch caused by a narrow clearance with the through hole 92 of the circuit board 90 to be discussed below. The linking section 74 is made narrower than the contacting section 66 and the tie-in section 68. Because of this, it becomes possible to make tool ends 82 located at the extremities of the contacting section 66 and the tie-in section 68 aligned with the lugs 78, thus making it possible to reliably secure contact 60 in the insulating housing 10.

Contact 64 shown in the FIG. 6 is almost the same as the contact 60; it is different from the contact 60 only by the size and shape of the linking section 76 and by the length of the tie-in section 72. Since the linking section 76 is longer than the linking section 74, the shape of the contact 64 can be easily modified after it was manufactured. For this purpose, the middle portion 77 of the linking section 76 is made wider in order to increase its strength.

The contact 62, which is not shown in the drawings, is similar to the contact 60, except that the length of its tie-in section 70 is shorter than that of the tie-in section 68 of the contact 60. In other words, it is contact 60 having the tie-in section 72 of the contact 62.

Figure 7:
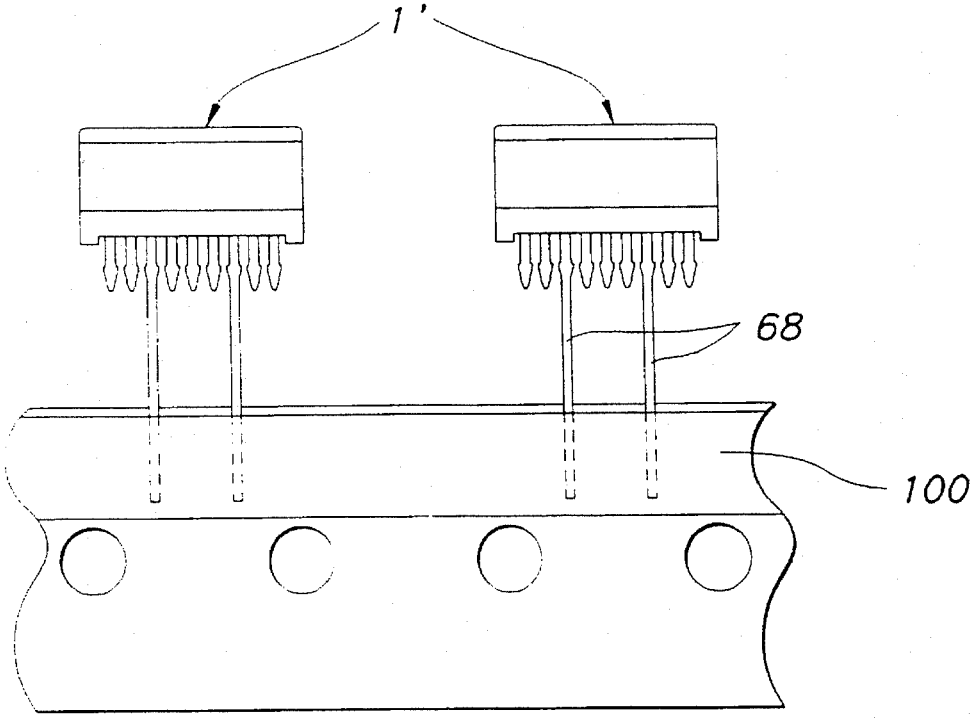
FIG. 7 is another embodiment of the tape-carrier type electrical connector according to this invention attached to a carrier tape.

FIG. 7 depicts another embodiment of an electrical connector fixed to a carrier tape. Connectors 1' have 9 contacts, two more than the connector 1. Long tie-ins 68 are located symmetrically. As shown in the drawing, the long tie-ins 68, which also are used as posts for radial mounting, are attached to carrier tape 100. Tie-ins 68 of connectors 1' attached to the carrier tape 100 are cut by the user near the carrier tape 100, thus separating them from the carrier tape, after which they are placed on a circuit board by chuck or other device. When the connector is placed on the circuit board, the tie-ins 68 are fixed to the circuit board by clinching and at the same time are shortened. After that the connector is soldered to the circuit board.

FIG. 8 represents another embodiment of an electrical connector according to this invention. Electric connector 101 is basically similar to the electrical connector 1. Similar parts have the same numbers as in the first embodiment increased by 100. The following explanations will concern mostly the points of difference from the first embodiment. The electrical connector 101, like electrical connectors 1 and 1', has a rectangular insulating housing 110, cover 150 closing the upper surface of the insulating housing 110, and three types of contacts 160, 162 and 164 contained in the insulating housing 110. In the center of rectangular body 152 of the cover 150, there is a groove 153 running from one edge to another. This groove 153 forms a reinforcing element 153*a* having roughly C-shaped cross section which adds strength to the body 152 and prevents its deformation. At both ends of the body 152, latching arms 154 are provided which are perpendicular to the body 152. As shown in the FIG. 8(D), the latching arms are not symmetrical, their lower ends 155*a* and 155*b* are at different positions. Recesses 123*a* and 123*b* made for the latching arms in the side walls 122 of the insulating housing 110 are not symmetrical either. Therefore, the cover 150 can be placed on the insulating housing 110 only in one position, eliminating possibility of an error. Recesses 155*c* and 155*d* are provided for ejector pins (not shown in the drawing) used for removal of the cover 150 from the mold (not shown in the drawing).

The insertion openings 132 for contacts of a matching connector (not shown in the drawing) which are linked to the contact chamber 126 of the insulating housing 110 have tapered surfaces 134 and beads 136 molded on the inner walls near the edge of the tapered surfaces. Free ends of these beads 136 are very close to partition 127 (see FIG. 8(B)) dividing the contact chamber 126. Because of that, the insertion openings 132 are effectively closed by the beads 136, thus preventing penetration of the flux from underneath. At the same time, since the beads 136 have very good flexibility due to their relatively long shape, they provide very small resistance to contacts or wires being inserted through the opening. The function of empty cavities 128 and 130 of the insulating housing 110 is to prevent the flux (not shown in the drawing) from rising along tie-ins 168, 170 and 172 of the contacts 160, 162 and 164. The contacts 160, 162 and 164 have the linking sections of the same configuration and they retain the same shape after being placed in the insulating housing 110.

Figure 11:
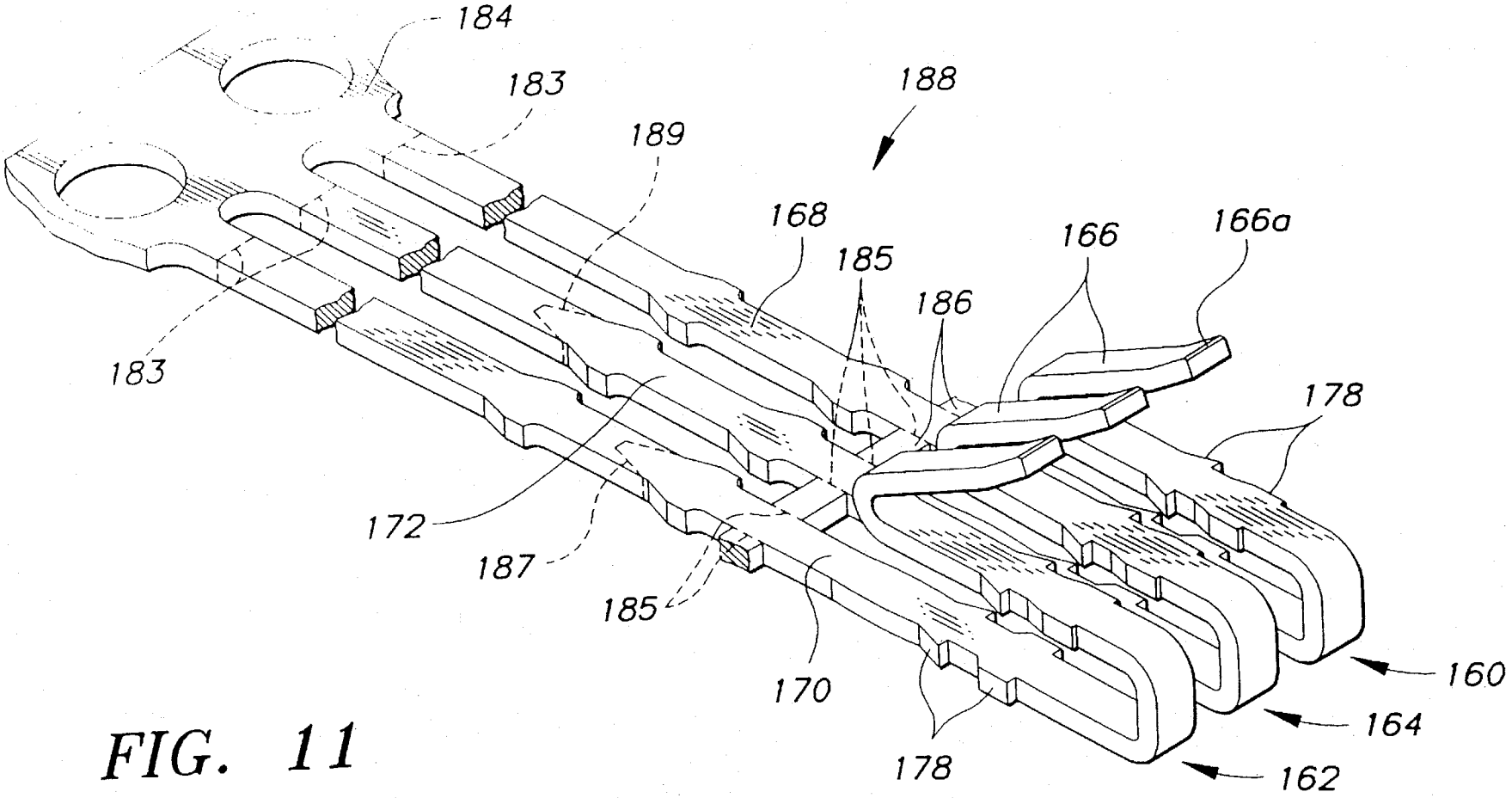
FIG. 11 is a perspective view of the cluster of the contacts used in the connector shown in FIG. 8.

FIG. 11 is a perspective view of a cluster of contacts used in the connector shown in the FIG. 8. Contacts 160, 162 and 164 are stamped from a sheet material of a copper alloy, treated and bent to a required configuration. They are of the same shape and are connected in a cluster 188 by means of a carrier 184 and an intermediate carrier 186. Prior to or after the insertion in the insulating housing 110, the contacts are cut to different lengths forming three types of contacts 160, 162 and 164.

Figure 10:
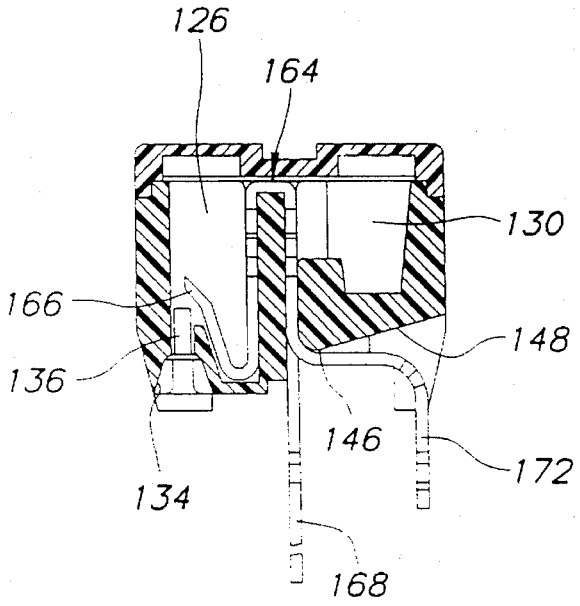
FIG. 10 is a cross sectional view along line X—X in FIG. 8(B).

Next, we will explain the process of assembly of the electrical connector shown in FIG. 8. First, contact cluster 188 shown in the FIG. 11 is prepared by stamping from a metal sheet, treatment and bending. Next, the contact cluster 188 is cut off along the broken lines 183 from the carrier 184. After that, the contact cluster 188, separated from the carrier 184, is temporarily inserted in the insulating housing 110 from the top. When the tie-in sections 168, 170 and 172 appear from the bottom of the insulating housing 110, the intermediate carrier 186 is cut off along the broken lines 185 (FIG. 11), thus separating contacts 160, 162 and 164 from each other. Next, the contacts 160, 162 and 164 are inserted further, so that their lugs 178 become engaged with the inner walls of the insulating housing 110, thereby securing the contacts in the insulating housing 110. In addition, it is possible to make embossments at the lugs 178 or near them, thus increasing the apparent thickness of the metal, which provides additional retaining strength by adding pressure in the direction of the metal thickness. Next, the contacts are cut along broken lines 187, 189 (FIG. 11), bringing the tie-ins 170 and 172 of the contacts 162 and 164 to their final lengths. At that time, three types of contacts (160, 162 and 164) form one row in the middle of the bottom 120 of the insulating housing 110. Next, the tie-in 172 of the contact 164 is bent to the configuration shown in the FIG. 10 by a special tool (not shown in the drawing) following the curved surface 148 and the tapered surface 146 of the bottom 120 of the insulating housing 110. After that, the tips of the longest tie ins 168 are glued to the carrier tape 100 (see FIG. 7). It is also possible to insert contacts 160, 162 and 164 in the insulating housing 110 after cutting off the carrier 184 and the intermediate carrier 186 and cutting the tie-ins 170 and 172 to their final lengths. In such a case, the cutting can be carried out in one operation. Since all contacts in this embodiment are of the same configuration, and differ only by lengths, the parts control during the manufacturing process is substantially facilitated. All these factors make it possible to reduce production costs.

Above, we gave explanations concerning preferred embodiments of the electrical connector according to this invention. However, this invention is not limited to only these embodiments, but can also comprise various modifications and changes made within the scope of essential features of the invention. For example, the number of contacts may be different from 7 or 9. The contacts may be made by stamping only. The contacting section of the contacts may be made in the shape of a tuning fork or some other configuration, and it can be either female or male type.

The tape-carrier type electrical connector features small size and suitability for high-density applications. At the same time, due to reduced number of components, it is possible to reduce production costs.

When these connectors are used in bottom entry applications, through holes made for tie-ins and opening for a matching connector in the circuit board to which the connector is mounted can be spaced sufficiently far from each other, thus reducing the risk of cracks in the circuit board.

The method of manufacture makes it possible to reduce production costs due to the fact the number of molds required for stamping 3 types of contacts is reduced to a minimum, thus improving the conditions for parts (including the molds) control in the manufacturing process.

I claim:

1. An electrical connector, comprising:

a housing having a top surface, a bottom surface and contact chambers therein, the contact chambers having openings along the bottom surface; and contacts disposed in said housing and having connection sections and termination posts, the termination posts extend from the bottom surface of said housing in two rows, one row being along a center line of the bottom and the other row being along one side of the bottom and parallel to the center line, the connection sections being disposed in the contact chambers for receiving matable contacts therein, the openings being disposed along the bottom surface of said housing in a row along another side of the bottom surface;

said contacts having linking sections connecting the termination posts to the connection sections, alternate ones of said contacts have short linking sections and the termination posts extend from the bottom surface along the center row, other alternate ones of said contacts have long linking sections with the posts thereof being disposed in the row along the side of the bottom surfacer whereby the posts are staggered from each other;

the posts being receivable in through holes in a circuit board and the openings being in alignment with an opening in the circuit board.

2. The connector as in claim 1, wherein the linking sections have ends and the connection sections and the termination posts extend from the ends parallel to each other, the connection sections having V-shapes and the termination posts having barbs for securing said contacts in said housing.

3. The connector as in claim 2, wherein the top surface of said housing is open for insertion of said contacts therein, the connector further comprises a cover for enclosing the top surface of said housing, said cover having arms which are attachable to said housing to secure the cover thereon.

4. An electrical connector, comprising:

a housing having a top surface, a bottom surface and contact chambers therein, the contact chambers having openings along the bottom surface; and contacts disposed in said housing and having connection sections and termination posts, the termination posts extend from the bottom surface of said housing in two rows, one row being along a center line of the bottom and the other row being along one side of the bottom and parallel to the center line, the connection sections being disposed in the contact chambers for receiving matable contacts therein, the openings being disposed along the bottom surface of said housing in a row along another side of the bottom surface;

said contacts being formed from identical blanks having termination posts cut to different lengths, said contacts having identical linking sections between the connection sections and the termination posts, alternate ones of said contacts have the termination posts extending through and straight down from the bottom of said housing along the center row of said bottom surface, other alternate ones of said contacts have the termination posts which extend through said housing and being bent along the bottom surface so as to extend downward along the side row of the bottom surface;

the posts being receivable in through holes in a circuit board and the openings being in alignment with an opening in the circuit board.

5. The connector as in claim 4, wherein the linking sections have ends and the connection sections and the termination posts extend from the ends parallel to each other, the connection sections having V-shapes and the termination posts having barbs for securing said contacts in said housing.

6. The connector as in claim 4, wherein the top surface of said housing is open for insertion of said contacts therein, the connector further comprises a cover for enclosing the top surface of said housing, said cover having arms which are attachable to said housing to secure the cover thereon.

7. An electrical connector to be carried on a carrier member, comprising:

a housing having a bottom surface; and contacts disposed in said housing having connection sections for electrical connection with a matable connector and termination posts for insertion in through holes of a circuit board, the termination posts extending along two rows on the bottom surface, one row being along a center line of the bottom surface and the other row being along one side of the bottom surface and parallel to the center line, at least two of the termination posts extending along the center row being longer than the other termination posts for securing said posts to the carrier member;

said housing having openings for receiving matable contacts along another side of the bottom surface, the connection sections being disposed in cavities proximate to the openings;

said contacts having linking sections connecting the posts to the connection sections, alternate ones of said contacts having short linking sections and the termination posts thereof extending from the bottom surface along the center row, other alternate ones of said contacts having long linking sections with the posts thereof being disposed in the row along the side of the bottom surface, whereby the posts are staggered from each other.

8. The connector as in claim 7, wherein the top surface of said housing is open for insertion of said contacts therein, the connector further comprises a cover for enclosing the top surface of said housing, said cover having arms which are attachable to said housing to secure the cover thereon.

9. The connector as in claim 7, wherein said housing has openings for receiving matable contacts along another side of the bottom surface, the connection sections being disposed in cavities proximate to the openings.

10. An electrical connector to be carried on a carrier member, comprising:

a housing having a bottom surface; and contacts disposed in said housing having connection sections for electrical connection with a matable connector and termination posts for insertion in through holes of a circuit board, the termination posts extending along two rows on the bottom surface, one row being along a center line of the bottom surface and the other row being along one side of the bottom surface and parallel to the center line, at least two of the termination posts extending along the center row being longer than the other termination posts for securing said posts to the carrier member;

said contacts being formed from identical blanks having termination posts cut to different lengths, said contacts having identical linking sections between the connection sections and the termination posts, alternate ones of said contacts have the termination posts extend through said housing and straight down from the bottom of said housing along the center row of the bottom surface, other alternate ones of said contacts have posts which extend through said housing and being bent along the bottom surface so as to extend downward along the side row of the bottom surface.

11. The connector as in claim 10, wherein the top surface of said housing is open for insertion of said contacts therein, the connector further comprises a cover for enclosing the top surface of said housing, said cover having arms which are attachable to said housing to secure the cover thereon.

12. The connector as in claim 10, wherein said housing has openings for receiving matable contacts along another side of the bottom surface, the connection sections being disposed in cavities proximate to the openings.

* * * * *